United States Patent [19]

Eglise et al.

[11] Patent Number: 4,491,140

[45] Date of Patent: Jan. 1, 1985

[54] COIN HANDLING APPARATUS

[75] Inventors: David Eglise, Windsor; Alan J. Ruddell, Iver, both of England

[73] Assignee: Mars Incorporated, McLean, Va.

[21] Appl. No.: 425,531

[22] Filed: Sep. 28, 1982

[30] Foreign Application Priority Data

Sep. 29, 1981 [GB] United Kingdom ..... 8129397

[51] Int. Cl.[3] ..... G07D 9/06

[52] U.S. Cl. ..... 133/8 R; 194/1 N

[58] Field of Search ..... 194/1 N, 1 M, 1 C, DIG. 3, 194/DIG. 14, 10; 133/8 R, 8 D, 1 A

[56] References Cited

U.S. PATENT DOCUMENTS

| | | | |
|---|---|---|---|
| 3,948,377 | 4/1976 | Hayashi et al. . | |
| 4,056,181 | 11/1977 | Ikeguchi et al. . | |
| 4,096,933 | 6/1978 | Massa . | |
| 4,280,181 | 7/1981 | Levasseur | 194/1 N |
| 4,286,703 | 9/1981 | Schuller et al. . | |

FOREIGN PATENT DOCUMENTS

| | | |
|---|---|---|
| 819235 | 9/1959 | United Kingdom . |
| 930925 | 7/1963 | United Kingdom . |
| 1088639 | 10/1967 | United Kingdom . |
| 1307426 | 2/1973 | United Kingdom . |
| 1415162 | 11/1975 | United Kingdom . |
| 1566202 | 4/1980 | United Kingdom . |
| 1566201 | 4/1980 | United Kingdom . |
| 1576180 | 10/1980 | United Kingdom . |
| 2066541 | 7/1981 | United Kingdom . |
| 2088108 | 6/1982 | United Kingdom . |

OTHER PUBLICATIONS

WO-A-8000202, UMC Industries, Feb. 7, 1980.

*Primary Examiner*—Stanley H. Tollberg

*Attorney, Agent, or Firm*—Davis, Hoxie, Faithfull & Hapgood

[57] ABSTRACT

A microprocessor-controlled coin handling apparatus, for example for a vending machine, has a plurality of change tubes each of which is provided with a single level sensor for determining whether or not the number of coins in the respective tube is greater than a predetermined number. The microprocessor keeps a count of the coins in the tube. When the power is turned on, the count is set to zero if the sensor indicates that the number of coins is less than the predetermined number, and is set to a predetermined "full" number otherwise. The microprocessor increments and decrements the counts as coins are delivered to and dispensed from the change tubes. Whenever the level of coins rises or falls such that the sensor output changes, the coin count is automatically corrected. Also disclosed is a non-volatile memory for storing parameters determining how the coins are handled. Keys are provided for accessing and altering the contents of the memory. Some contents are accessible in a first mode, whereas other contents are inaccessible in this mode, and require a second or third access mode to be entered. At least one location can be altered in a first manner during one of the access modes, and in a second manner only during a different access mode.

36 Claims, 6 Drawing Figures

COIN HANDLING APPARATUS

This invention relates to coin handling apparatus.

The invention is particularly, but not exclusively, related to apparatus which can accept, store and dispense coins. Such apparatus is often used with coin-operated vending machines. The apparatus tests inserted coins and stores them if they are acceptable. Unacceptable coins are rejected. If sufficient acceptable coins are inserted, the vending machine is operated. The apparatus dispenses stored, acceptable coins as change.

Such apparatus generally includes a separate coin container for the or each denomination of coin to be dispensed, and a cashbox for any other coin denominations. When a coin container for a particular denomination of coin is full, any further incoming coins of the same denomination are directed to the cashbox.

This arrangement uses a pair of sensors for each of the coin containers. One of the sensors is used to determine when the coin container is full so that further coins are directed to the cashbox. The other sensor determines when the coin container is empty, or near empty, as a result of which the coin apparatus may no longer be able to dispense change, and will give a display indicating that the correct amount should be inserted.

Each coin container may be a tube which stores the coins in a stack. The empty and full level sensors are mounted adjacent the upper and lower ends of the stack. Each sensor may comprise a light source and a light sensor positioned on opposite sides of the tube so that the light path is intercepted when a coin is at the appropriate level in the tube.

The fact that each coin container requires two level sensors makes the containers rather expensive and difficult to construct. Another problem arises in that although the cashbox is regularly emptied, the containers are not and the apparatus tends to keep each container substantially full. This means that the total value of coins kept stored in each vending machine tends to be fairly high. Owners of a fairly large number of vending machines may find the total value of money tied up in the machines in this manner to be unacceptable.

One could reduce this amount of money by altering the position of the full level sensor. This would of course reduce the number of times the apparatus could dispense change without being replenished. One could reach a position providing a suitable compromise, but the differing requirements of different vending machine owners may require that they have differently-positioned level sensors. Adapting the level sensors to each owner's particular requirements would of course substantially increase the manufacturing difficulties.

According to the present invention there is provided a coin handling apparatus having at least one coin container into which the apparatus can selectively direct coins and from which the apparatus can selectively dispense coins, the apparatus having means for keeping a count of coins in the container and being responsive to said count for determining whether coins are to be directed to or dispensed from the container.

The apparatus can be arranged to store coins in the coin container until the level reaches a predetermined "full" value, which is preferably stored in an alterable memory. Thus, the maximum amount of coins stored in the container can easily be adjusted to suit differing requirements.

Accordingly, the apparatus of the invention does not need to have the full level sensor to determine when the coin container is full. Preferably, however, the coin container does not have one level sensor which is desirably placed close to, but preferably not at, the bottom of the coin container. The advantage of using such a level sensor is that, as will be described in more detail later, it can be used to correct inaccuracies in the count of coins in the container which may be caused by, for example, coins being manually inserted into the container while the apparatus is switched off and thereby unable to detect the insertion of the coins.

It is not, however, necessary that the apparatus keep an accurate count of the coins in the container, and indeed the apparatus could instead merely use a single level sensor to provide an indication of whether the level of coins in the container is above or below a predetermined level, the apparatus thereafter controlling the storing and dispensing of the coins in accordance with the indication from the level sensor. Accordingly, in another aspect of the invention there is provided a coin handling apparatus having at least one coin container into which the apparatus can selectively direct coins and from which the apparatus can selectively dispense coins, the apparatus having a sensor to provide an output indicating whether or not the number of stored coins in the container is greater than a predetermined number, the apparatus being responsive to the output of the sensor for determining whether coins are to be directed to or dispensed from the container.

In theory one could control whether dispensing or further storing of coins is to take place solely on the basis of the sensor output. This would have the advantage that only one level sensor is required, rather than two as in the prior art, but would have the disadvantage that the apparatus would be incapable of giving successive amounts of change without being frequently replenished.

Accordingly, it is preferred that the above two aspects of the invention be combined, whereby the apparatus is arranged to keep an estimated count of the coins in the container, which count is incremented and decremented when coins are respectively directed to and dispensed from the container, the apparatus being operable to adjust the count if necessary when the level sensor indicates that the number of coins in the container has risen above a predetermined number, and/or when the sensor indicates that the number of coins has dropped to the predetermined number.

In a preferred arrangement of the invention, when the apparatus is switched on the initial count of coins in the container is set to zero if the sensor indicates that the number of stored coins is not greater than the predetermined number, and set equal to the maximum permitted number of coins in the container if the sensor indicates that the number of coins in the container is greater than this predetermined number. Thereafter, any alteration in the number of coins in the container will be such that this predetermined number is approached. This is because, if the count is initially set at zero, the apparatus may direct further coins to the container but will not allow coins to be dispensed such that the count would fall below zero. If the initial count is set to the maximum value, the apparatus may dispense coins but will only direct further coins to the container if this stored maximum count value will not be exceeded. If and when the sensor indicates that the number of stored coins has risen above or dropped to the predetermined number, the stored count is corrected.

The predetermined number is preferably stored in an alterable memory to allow adjustment for use of the apparatus with coin containers having sensors at different levels. The maximum permitted number of coins in the container is also preferably alterable to permit adjustment of the maximum cash value stored in the container at any time, and thereby facilitate adjustment to suit different owners' requirements and avoid the problems mentioned above. The arrangement of the invention has an additional advantage, in that the apparatus assumes that the coin container is filled to its maximum permitted level if on switch-on the number of coins in the container exceeds the predetermined number detected by the sensor. In fact, it is likely that there is less than the maximum permitted number of coins in the container. This means that the level of coins will not be permitted to rise so that the total cash value stored in there stays at less than the maximum permitted value until after the demand for change increases so that the level drops and the count is corrected.

The term "level sensor" is used herein to describe a sensor which indicates when the number of coins stored in the container is greater than the predetermined number. Although in the preferred arrangement the coins are stored in a vertical stack so that this predetermined number will correspond to a predetermined height or level, this is not necessarily the case and other storage arrangements in which the number of stored coins does not correspond to any particular height could be used.

In coin handling apparatus it is desirable to provide a control circuit which can be used, with a minimum amount of modification, in conjunction with mechanisms and storage facilities suitable for different types of coins, for example the coins of different countries. It may also be desirable for a number of reasons to be able to change the way in which the control circuit operates. The maximum number of coins to be stored in the or each coin container, as referred to above, is one example of a parameter which is desirably alterable.

Other aspects of the invention involve the use of an addressable non-volatile memory, and means for accessing the memory, in order to change the way in which the control circuit operates.

One further aspect of the invention relates to the provision of a coin handling apparatus having means for directing coins along different paths to different locations, and a control circuit for operating the directing means in accordance with signals from a coin validator and in accordance with at least one parameter stored in an addressable non-volatile memory, the circuit further including accessing means for accessing and altering said at least one parameter.

This parameter may be the maximum permitted number of coins in a coin container. The control circuit would cause a coin to be directed to the container if the validator indicates that the coin is of the right denomination and the number of coins already in the container is less than the maximum permitted number. The ability easily to alter this maximum permitted number has the advantages set out above.

Preferably however the accessing means can be used to access and alter a number of further parameters relating to the way in which coins are handled. For example, if the apparatus has a number of separate coin containers, the memory contents may determine which denominations of coins go to the respective containers.

The coins may be directed to their respective locations by movable gates, in which case the memory contents may also determine the sequence in which the gates are operated, and the intervals for which they are operated.

In an alternative aspect of the invention, instead of coin-handling parameters the memory stores other information, e.g. information relating to the values of acceptable coins. Preferably, however, both coin value information and coin-handling parameters are stored.

The control circuit may be capable of operation with more than one type of validator. An alterable memory location could be used to identify to the control circuit which validator is being used.

The memory may also store, in an alterable fashion, one or more price settings the or each of which determines how much cash has to be fed to the apparatus before a product will be vended. Previously, the setting of prices has been achieved by operating switches in a control circuit. By storing the price settings in an accessible memory the need for such switches is obviated. Also, the structure and operation of the apparatus is simplified by providing a common memory and accessing means for price settings and for additional parameters affecting the operation of the apparatus.

If the control circuit is arranged to keep a count of coins stored in one or more coin containers each provided with a single level sensor, as described above, another parameter which can be stored in an alterable fashion is the predetermined number of coins which is detected by the single level sensor. This enables the control circuit to be used with different coin containers, or coin containers having differently-positioned level sensors, or containers for use with coins of different thicknesses. The coin count could also be stored in a non-volatile fashion but in view of the possibility of manually altering the level of coins when the power is off, it is preferred that the coin count be initialised each time the apparatus is switched on. The coin count can thus be stored in a volatile memory.

Previously many, or all, of the coin-handling parameters have been unalterable, which required the construction of different circuits for different types of apparatus. Although switches could have been provided for altering these parameters, as was done for price setting, this would have taken up a great deal of space, increased costs and enabled unauthorised tampering with the circuit to alter the way in which the apparatus operates. The provision of a non-volatile, accessible and alterable memory for storing these parameters now enables a single control circuit to be used in a variety of different apparatuses.

The unauthorised alteration of the way in which the apparatus operates can be prevented by employing a further aspect of the invention, in which an addressable non-volatile memory storing information determining the way in which the apparatus operates has some memory locations which are accessible by operating an input means in a predetermined manner, and other memory locations which require the input means to be operated in a different manner before they become accessible. Thus, two levels of access are provided, although of course further levels could also be provided if desired. This allows certain memory locations, such as those used for price setting, to be easily accessible, and preferably alterable while other memory locations storing for example coin-handling parameters can be accessed only by authorised operators who know the correct way of operating the input means in order to gain access. By way of example, the predetermined manner of operation required to gain access to particular memory locations may involve inserting a predetermined value into a memory location to which access is already provided.

The use of a non-volatile memory is required to ensure that the stored information determining the way in which the apparatus operates, including the way it handles incoming coins, is not lost when the power to the apparatus is shut off. The term "non-volatile" is used herein in a broad sense to refer to any kind of memory which can retain information when the main power to the apparatus is interrupted. This could for example be achieved by using a separate battery power supply for the memory.

However, in a preferred embodiment of the invention the non-volatile memory is of a type which retains its contents when its own power supply is terminated. In the embodiment to be described below, the non-volatile memory is an electrically alterable read-only memory (EAROM). However, other memories, such as magnetic bubble type memories, could be used instead.

Thus, in a still further aspect of the invention, there is provided a coin handling apparatus having a control circuit for determining the way in which the apparatus operates in accordance with information stored in a memory having electrically alterable contents and of a type which retains its contents when its power supply is interrupted.

In accordance with a still further aspect of the invention, a control circuit for a coin handling apparatus is operable to keep an accumulated total of credit which is incremented in response to the insertion of acceptable coins into the apparatus and which is decremented upon the vending of a product, the control circuit being periodically operable to increment the accumulated total without acceptable coins being inserted, the control circuit having an addressable memory with alterable contents determining when said incrementing without the insertion of acceptable coins is to take place. Thus, the apparatus is provided with a "discount" feature whereby under certain circumstances a user of the machine may be given extra credit without having to insert coins. This facility is preferably provided in an apparatus capable of giving change, so that the user can select whether the extra credit is to be given in the form of change or a vended product.

The apparatus is preferably operable in a "multivend" mode, whereby a user can insert coins to accumulate a credit sufficient to purchase more than one product, and then successively operate the apparatus to vend the products without having to insert coins between the vending operations. In these circumstances, the extra "discount" credit can be given only if the user successively operates the apparatus to vend a predetermined number of products (as determined by the contents of the memory) in a single operation. Alternatively, the discount is provided only if the user purchases, in a single operation, products having a total value at least equal to a predetermined, stored amount.

The apparatus may however additionally, or alternatively, provide the "discount" credit in a "single-vend" mode, in which case the apparatus may provide the "discount" credit after a predetermined number of operations of the apparatus.

The ability easily to alter the contents of the memory determining when the "discount" credit is given enables the apparatus to be easily adjusted to suit individual owner's requirements.

Preferably the coin handling apparatus is provided with a digital display which can be operated to reveal the contents of some or all of the memory locations. The display may also provide a display of memory addresses, so that the memory can be accessed by operating an input means (e.g. pushbuttons) until the correct memory address is shown, the display then being operated to enter a mode in which it displays the contents of the selected memory location, which contents can then be altered.

The display could also be used to display the status of various parts of the circuitry of the coin handling apparatus.

Preferably, the control circuit includes a microprocessor.

An arrangement embodying the invention will now be described by way of example with reference to the accompanying drawings, in which.

Figure 2:
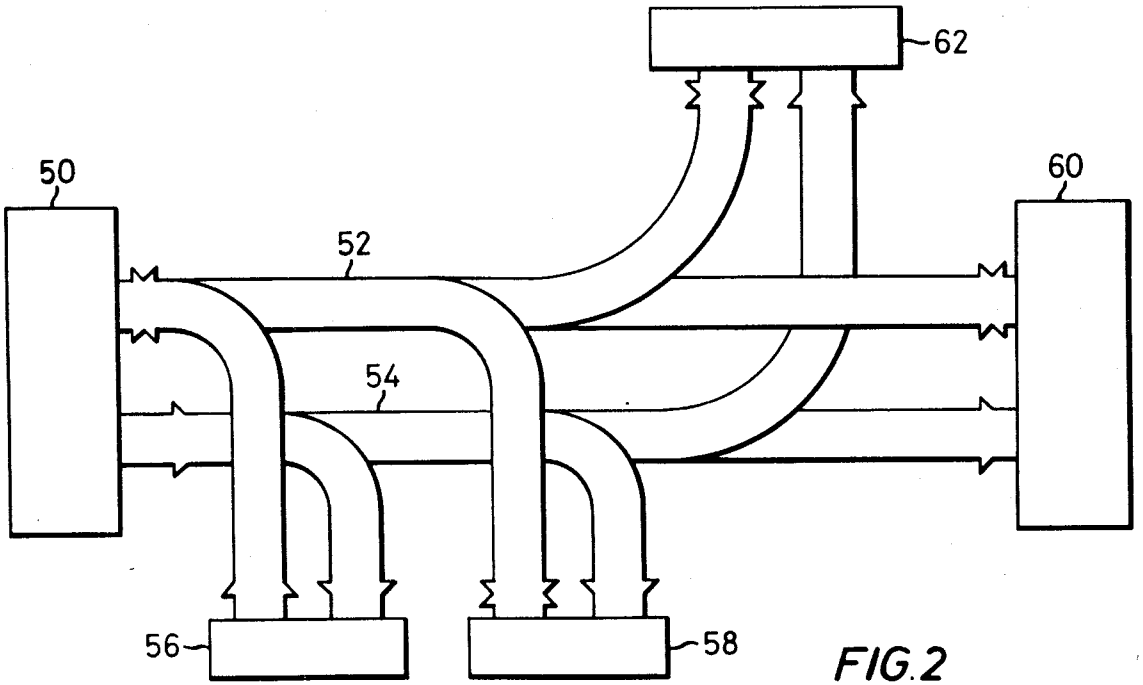
FIG. 2 is a block diagram of the circuit of the coin handling apparatus.
Figure 3:
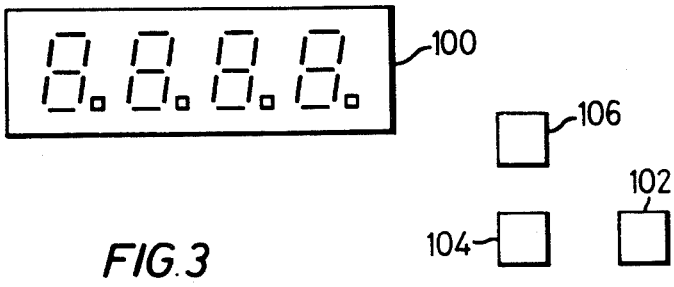
Figure 4:
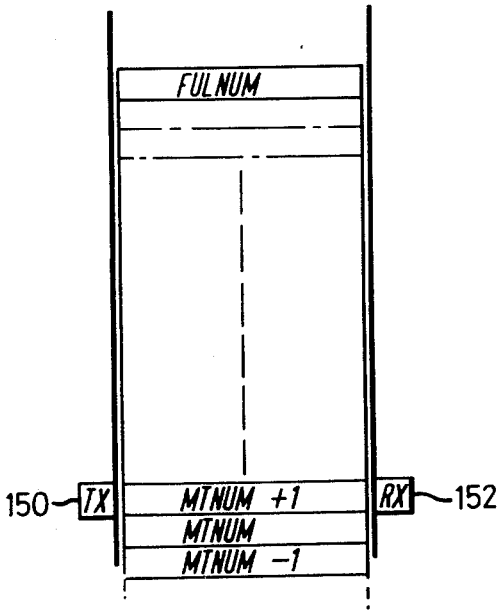
Figure 5:
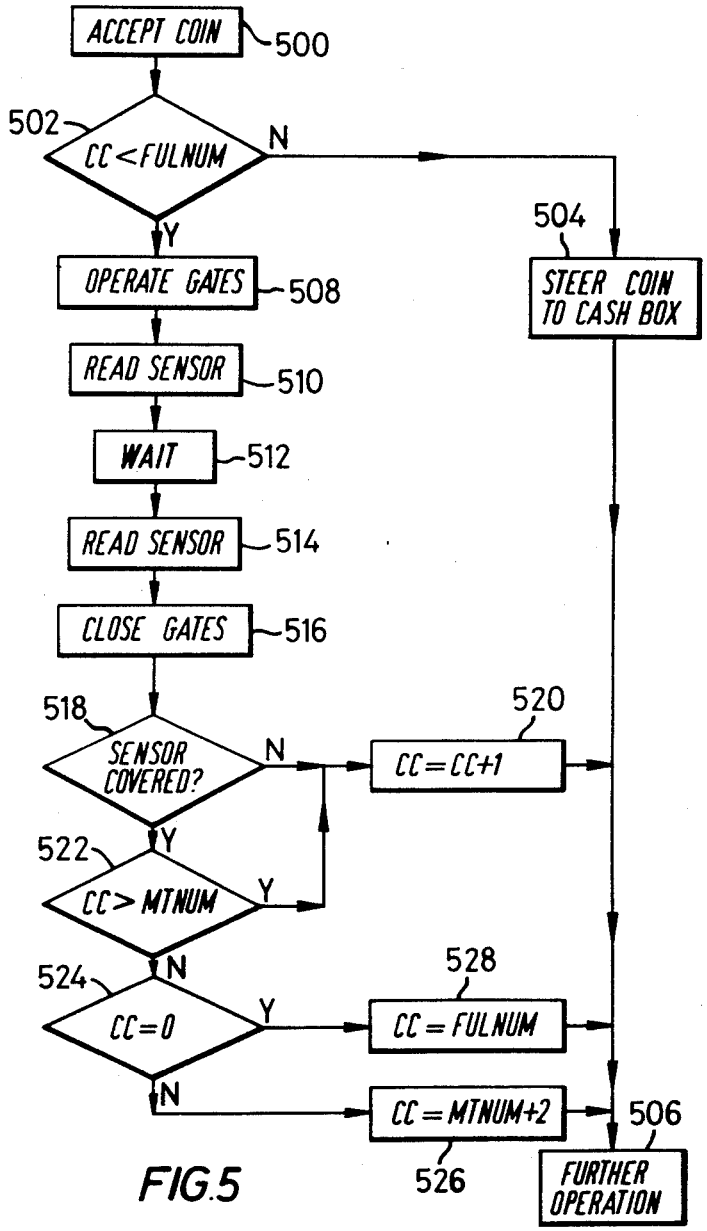
Figure 6:
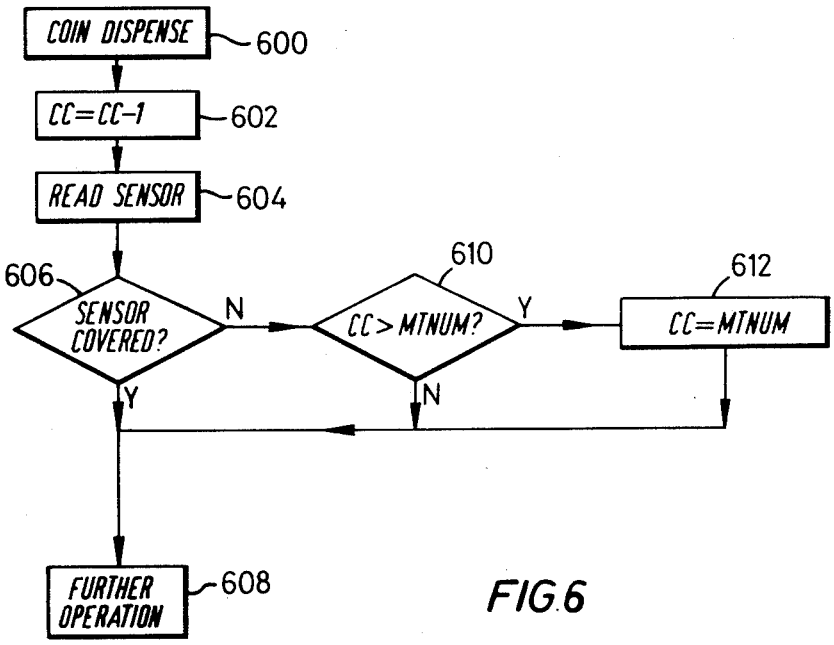

FIG. 3 schematically shows an arrangement for accessing and altering the contents of a memory of the circuit shown in FIG. 2;

FIG. 4 schematically shows one of the coin storage containers of the apparatus; and FIGS. 5 and 6 are flow charts to describe some of the operations carried out by the apparatus.

Figure 1:
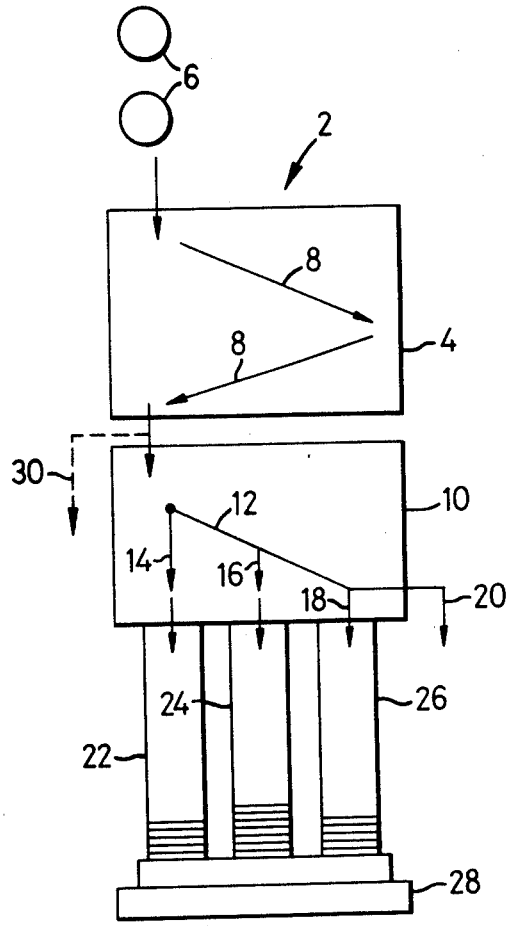
FIG. 1 is a schematic diagram of the mechanical part of a coin handling apparatus in accordance with the invention.

Referring to FIG. 1, the coin handling apparatus 2 includes a coin validator 4 for receiving coins as indicated at 6. During the passage of the coins 6 along a path 8 in the validator 4, the validator provides signals indicating whether the coins are acceptable, and if so the denomination of the coins.

Acceptable coins then enter a coin separator 10, which has a number of gates (not shown) controlled by the circuitry of the apparatus for selectively diverting the coins from a main path 12 into any of a number of further paths 14, 16 and 18, or allowing the coins to proceed along the path 12 to a path 20 leading to a cashbox. If the coins are unacceptable, instead of entering the separator 10 they are led straight to a reject slot via a path 30.

Each of the paths 14, 16 and 18 leads to a respective one of three coin containers 22, 24 and 26. Each of these containers is arranged to store a vertical stack of coins of a particular denomination.

A dispenser indicated schematically at 28 is operable to dispense coins from the containers when change is to be given by the apparatus.

The arrangement so far is quite conventional, and the details of particular structures suitable for using as various parts of the mechanism will therefore not be described in detail.

Referring to FIG. 2, the circuit of the present embodiment of the invention incorporates a microprocessor 50 connected to data and address buses 52 and 54. Although separate buses are shown, data and address signals could instead be multiplexed on a single bus. A bus for control signals could also be provided.

The microprocessor 50 is connected via the buses 52 and 54 to a read-only memory (ROM) 56 and a random access memory (RAM) 58. The ROM 56 stores the program controlling the overall operation of the microprocessor 50, and the RAM 58 is used by the microprocessor 50 as a scratch-pad memory.

The microprocessor 50, the ROM 56 and the RAM 58 are, in the preferred embodiment, combined on a single integrated circuit.

The microprocessor 50 is also connected via the buses 52 and 54 to an EAROM 60. The EAROM 60 stores a variety of alterable parameters to be described in more detail later. The EAROM 60 may be of a type which inputs and outputs data in a serial fashion, in which case it may be connected to only a single data line, instead of the data bus 52.

The microprocessor 50 is also coupled via the buses 52 and 54 to input/output circuitry indicated at 62. The circuitry 62 includes a level sensor for each of the coin containers 22, 24 and 26, circuits for operating the dispenser 28 and the gates of the coin separator 10, the circuitry of the coin validator 4, a display visible to a user of the apparatus for displaying an accumulated credit value, and a further display and a set of switches to be described in connection with FIG. 3.

The input/output circuitry 62 also includes an interface between the control circuit of the apparatus and a vending machine to which it is connected.

In operation of the apparatus the microprocessor 50 successively tests the signals from the validator to determine whether a coin has been inserted in the apparatus. It also successively tests the signals from the switches to be described with reference to FIG. 3 to determine whether an operator desires to access the memory locations in the EAROM 60. When a credit has been accumulated, the microprocessor also tests signals from the vending machine to determine whether a vending operation has been carried out. In response to various signals received by the microprocessor 50, various parts of the program stored in the ROM 56 are carried out. The microprocessor is thus arranged to operate and receive signals from the level sensors of the coin containers 22, 24 and 26, and to control the gates in the separator 10 in order to deliver the coins to the required locations, and is also operable to cause appropriate information to be shown on the displays of the apparatus and to deliver signals to the vending machine to permit or prevent vending operations. The microprocessor is also operable to control the dispenser to deliver appropriate amounts of change.

The particular sequence of most of the operations carried out by the microprocessor may be the same as those determined by the hard-wired logic in previous apparatus. A suitable program to be stored in the ROM 56 can therefore be designed by anyone familiar with the art, and accordingly only the operations carried out by the particularly relevant parts of this program will be described.

Referring to FIG. 3, the control circuit is provided with a display 100 which can display four digits and a decimal point at any one of four locations each positioned after a respective digit. The circuit also has three pushbuttons, 102, 104 and 106, which can be operated to bring the display 100 into use.

In order to set the apparatus up for use, the pushbutton 102 (referred to as the "start" button) is operated. This is recognised by the microprocessor 50 which then, in accordance with the program stored in the ROM 56, causes the display to read zero. The displayed value can then be incremented by successively pressing the pushbutton 106 (referred to as the "up" button), and decremented by successively pressing the pushbutton 104 (referred to as the "down" button). In this way, the operator can bring the displayed number to any desired value within a predetermined range (above which the display returns to zero). Each of the displayable numbers corresponds to a particular memory location in the EAROM 60.

Once a desired number has been reached, the operator again presses the set button 102, following which the display 100 displays the contents of the appropriate memory location. These contents can then be incremented or decremented by using the up and down buttons 106 and 104, and the altered contents can be entered into the EAROM 60 by again pressing the set button 102. This operation of altering the memory contents can be terminated by pressing the set button 102 twice in succession.

This method is used to set in the EAROM 60 a number of prices so that when the apparatus is used, the microprocessor 50 will recognise when sufficient credit has been accumulated by the insertion of coins to deliver the signals which allow the vending machine to be operated.

By operating the buttons 102, 104 and 106 in a predetermined manner, the operator may gain access to further memory locations of the EAROM 60 (i.e. enter a "second access mode"). This could, for example, be done by inserting a particular value in a particular memory location which is normally accessible. Then, when the display has been incremented to the highest normally available address, the microprocessor can be arranged to look at the memory location storing that particular value and, on noting that the value is present, permit further incrementing of the display to further memory addresses.

This arrangement permits restricted access to certain memory locations. These memory locations can be used to store, for example:

(1) the maximum amount of change which the apparatus will dispense in a single operation. This ensures that a user cannot build up excessive credit and then recover the credit by way of dispensed cash unless he has first operated the vending machine in order to reduce the credit to below the set value.

(2) A "discount" value, which corresponds to the amount of credit awarded in a discount operation.

(3) A "discount" event number, which controls when a discount is to be awarded.

(4) The coin denominations which are acceptable by the apparatus when it is in a state in which it may not be able to deliver change (i.e. when an "exact change" indication is given).

(5) A value which determines whether the apparatus will operate in a single-vend or a multi-vend mode (as referred to above).

(6) A value which determines whether, once a credit has been accumulated, a vending operation must be carried out before any change is given by the apparatus.

Other parameters affecting circuit operation can also be stored.

Still further memory locations can be accessed by operating the pushbuttons 102, 104 and 106 in a further predetermined manner (to achieve a "third access mode"). These further memory locations would normally have appropriate values stored in them on manufacture of the apparatus, and would not require alteration on installation of the apparatus. However, it is useful to provide a third level of access whereby an operator can inspect locations, and can also alter these if this ever becomes necessary, for example if a mechanism with which the circuit operates is altered.

The memory locations which are addressed at this third level of access store parameters relating to the way in which coins are handled by the apparatus, and further parameters relating to the values of the coins with which the apparatus is intended to be used.

The coin handling parameters include timing values which determine how long gates are opened or closed, gating parameters which determine which location each denomination of coin is directed to by the gates, and dispensing timing values which determine how long a dispensing mechanism is to be actuated for, and how long the necessary delay period is between the end of one dispersing operation and the beginning of a succeeding dispensing operation. These latter values will depend upon coin size and weight.

The coin value parameters include the relative values of the coins, and a scale factor whereby actual coin values can be calculated and displayed on the credit display of the apparatus.

Other parameters would not normally need to be changed except in special circumstances may also be stored at this third level of access. For example, there may be a memory location storing the minimum number of coins in a coin container below which the apparatus will provide an "exact change" indication to warn that the apparatus may not be able to deliver change.

There may also be a memory location to identify the type of coin validator being used with the apparatus.

The apparatus can be used with an optional audit or accountability system which keeps a record of the transactions carried out by the apparatus. One of the memory locations stores a value indicating whether or not such an audit system is in operation. This memory location is at the third access level, so as to avoid unauthorised tampering with the contents of the location and thereby falsification of the accountability record. However, it is desirable to provide for situations in which an owner of the apparatus wishes to add an audit system to apparatus which has not previously been provided with such a system. To enable this to be achieved simply, there is provided a further memory location at the second level of access into which the owner can insert a special code which causes the microprocessor to enter into the "audit location" at the third level of access a code indicating the presence of an audit system. The microprocessor program is so arranged, however, that it is not possible to use the location at the second access level to cause the storage, in the audit location, of a code signifying that no audit system is in use; the third level of access is required to achieve this.

The result of this is that there is a memory location which can be altered to store at least one particular code indicating the presence of an audit system) at the second level of access, but can only be altered so as to store a different code (indicating the absence of an audit system) at the third level of access. This provides for simple and convenient modification when audit systems are being added, but prevents or makes very difficult tampering with the system to provide a false indication that there is no audit system present, which would result in the apparatus failing to record transactions.

Similar arrangements can be used for storing other parameters. It is of course also possible to have a corresponding arrangement at the first and second levels of access, rather than the second and third levels.

With the EAROM 60 storing the appropriate values, which have been entered on installation and/or manufacture, and the apparatus in a condition for use, an operator can use the display 100 and the pushbuttons 102, 104 and 106 to check on the operation of the apparatus. By operating the pushbuttons in a certain sequence, for example by pressing the down button 104 prior to pressing the set button 102, one can cause the microprocessor 50 to shift the display into a diagostic mode. In this mode, the display 100 (and/or the external credit display of the apparatus) displays numbers dependent upon the status of various parts of the apparatus. For example, the apparatus can be arranged to indicate whether any of the coin containers 22, 24 and 26 is empty, whether a sensor in the separator is providing a signal indicating that the separator is jammed, etc.

It is known in conventional coin handling apparatuses to direct coins to coin containers such as those shown at 22, 24 and 26 in FIG. 1, and to dispense the coins from the containers in a change dispensing operation. It is also known that the apparatus should recognize when the coins stored in each container reach a relatively low level, so that change may not be available and an indication that only the correct amount of cash should be inserted into the machine is given. Furthermore, it is known to detect when the level of coins is above a predetermined maximum level, so that further coins of the same denomination are directed to the cashbox instead of the coin container.

However, in the past this has usually been achieved by using two level sensors, one for detecting a low level of coins and the other for detecing a high level of coins. The present embodiment provides an arrangement which requires only one level sensor, but which nevertheless operates in the desired manner, as will be explained in the following.

Referring to FIG. 4, each coin container (only container 22 is illustrated in FIG. 4) has a single level sensor formed by a light source 150 and a light detector 152 mounted on opposite sides of the coin container. The level sensor can be operated at any desired time by the microprocessor sending a signal to illuminate the light source 150. This will produce an output from the light detector 152, which is delivered to the microprocessor 50, only if no coin blocks the light path between the source and the detector.

The sensor is located fairly close to, but not at, the bottom of the coin container, although other positions could be used instead. The light detector 152 provides an output signal when the light source 150 is operated only if the number of coins in the container is equal to or less than a predetermined number, referred to herein by the mnemonic MTNUM. Any further coins will block the light from the source 150.

Each time the microprocessor causes a coin to be directed to the coin container, a coin count stored in the RAM 58 for that particular container is incremented. The coin count is decremented every time the microprocessor 50 causes a coin to be dispensed from the container.

The way in which the apparatus operates to keep a count of the coins in the containers will now be described with reference only to the coin container 22. The operation for the other coin containers is identical.

When the apparatus is switched on, the microprocessor 50 reads the sensor 150, 152 associated with the container. If the sensor is uncovered (i.e. if the number of coins is less than or equal to MTNUM) then the microprocessor stores, as the coin count for that container, the value zero. If on the other hand the sensor is covered, then the value stored as the coin count is a further predetermined number referred to herein by the mnemonic FULNUM and corresponding to the desired maximum number of coins in the container.

The stored coin count is subsequent altered in accordance with coin dispensing and accepting operations.

The detailed operation of the apparatus when it receives an acceptable coin of the denomination stored in the container 22 will be described with reference to the flow chart of FIG. 5.

Following the recognition of an acceptable coin at step 500, the microprocessor determines whether the stored coin count (CC) is less than FULNUM at step 502. If not, i.e. if the count indicates that the maximum permitted number of coins is stored in the container, then at step 504 the microprocessor operates the gates to steer the coin to the cashbox. The microprocessor then proceeds, as indicated at step 506, to carry out any subsequent operations such as incrementing a credit total, signalling the vending machine, etc.

Assuming that the coin count is less than FULNUM, then in step 508 the microprocessor operates the steering gates in the separator 10 in order to direct the coin to the coin container 22.

The microprocessor then, in step 510, reads the level sensor for the coin container 22. There then follows a delay period in step 512, wherein the microprocessor waits for a period set by the contents of a location in the EAROM 60 which is alterable at the third level of access. During this period the coin is passing through the separator 10. Then, at step 514, the level sensor of the container 22 is read again.

At step 516 the gates directing the coin to the coin container 22 are closed.

At step 518 the microprocessor determines whether the level sensor of the container 22 is covered. This is done by "OR-ing" the results of the sensing operations at steps 510 and 514. In other words, if in either of these operations the sensor indicates that no coin is present, then the microprocessor assumes that the sensor is uncovered, i.e. that the number of stored coins is equal to or less than MTNUM.

The reason for carrying out the sensing operation twice, with an intervening pause, is to avoid the sensor erroneously indicating that the coin level is greater than MTNUM. This could otherwise occur if a previously accepted coin was passing the level sensor at the time the sensor is read. The delay between the two readings is such that a coin passing the sensor at the time of the first reading would have settled in the container by the time the second reading is taken, and on the other hand any coin passing the level sensor at the time of the second reading would not have reached the sensor when the first reading was taken.

The time between the opening and closing of the gates sending the coin to the coin container may also be determined by alterable contents of an EAROM location, and may be selected in accordance with the physical properties of the coin.

The period of operation of the gates can be selected as described in British Patent Specification No. 1,582,691.

If, as a result of the sensing operations, it is discovered that the sensor is not covered, the microprocessor proceeds to step 520, in which the coin count is incremented by 1, and to step 506.

On the other hand, if the sensor is covered; then the microprocessor proceeds to step 522. Here the microprocessor determines whether the stored coin count is greater than MTNUM. As the sensor has been found to be covered, then the count should indeed be greater than MTNUM, and if it is then the microprocessor proceeds to step 520 to increment the count.

However if the coin count is less than or equal to MTNUM, the microprocessor proceeds to step 524. At this step, the microprocessor determines whether the coin count is equal to zero. Under normal circumstances, the coin count would be greater than zero, in which case the microprocessor proceeds to step 526, in which the coin count is set equal to MTNUM plus 2. At this step therefore, the microprocessor corrects any errors in the coin count which may have resulted from the microprocessor, at switch-on, storing an initial count count of zero when in fact several coins were already stored in the container. Thus, step 526 corrects any inaccurate counts which are smaller than the actual number of coins in the container.

If at step 524, if the microprocessor determines that the coin count is equal to zero, it proceeds to step 528. A zero count should not in fact be obtained, because earlier deliveries of coins to the container in order to raise the level to a position at which the sensor is covered would have increased the coin count. However the zero count may in fact occur if the container has been manually filled, in which case the coin count would not have been incremented. In this situation the coin count would be completely wrong, and to deal with this problem the microprocessor, at step 528, stores the value FULNUM as the coin count. Any discrepancies between the value FULNUM and the actual number of coins in the container will be dealt with in subsequent operations to be described later.

After setting the coin count to the appropriate values, the program proceeds to step 506 and the subsequent operations of the apparatus.

The actual sequence of operations set out in FIG. 5, including the order in which the gates are opened and closed and the coin counts altered, can of course be modified.

The value MTNUM plus 2 which is stored in step 526 corresponds to the minimum value MTNUM plus 1 at which the sensor is covered, plus an extra 1 for the incoming coin which has just been accepted.

The operation of the apparatus when it is dispensing a coin from the container 22 will now be described with reference to the flow chart of FIG. 6. Coins are of course dispensed only if the coin count is greater than zero. In an alternative arrangement, the apparatus could be arranged to dispense coins only if the coin count is greater than another number, such as MTNUM.

Firstly, a change calculation is carried out to determine how many coins of each of the stored denominations are to be dispensed in accordance with the total amount of change and the stored numbers of coins (i.e. the coin counts). Then, for each of the coins to be dispensed, the following sequence is carried out.

At step 600, the coin is dispensed. Then at step 602, the coin count is decremented by 1. The sensor is read at step 604. In the dispensing operation, no problems arise from coins moving past the sensor, and accordingly the sensor is read only once.

At step 606, the microprocessor decides whether the sensor is covered. If it is covered, no modification of the coin count is performed, and the program proceeds to carry out any subsequent operations, such as calculating whether any further change is to be dispensed, altering the accumulated credit etc. as indicated at step 608.

It should be noted that, when the tube sensor is covered, the coin count may be greater than the actual number of coins in the container, but it should not be less than the actual number of coins. This is because the coin count is set to FULNUM on switch-on when the tube sensor is covered. If the coin count is equal to FULNUM, no further coins are directed to the coin container. This arrangement has the advantage that the actual number of coins stored in the container is never greater than FULNUM, and may in fact be kept at a value which is lower than FULNUM until the sensor becomes uncovered, in which case the count is corrected as described below. Thus, the actual amount of cash stored in the container is, for a while at least, kept lower than the maximum permitted value.

If, after the dispensing operation, the sensor is uncovered, the microprocessor proceeds from step 606 to step 610.

If the coin count is greater than MTNUM, then at step 612 the coin count is corrected by setting it equal to MTNUM. The program then proceeds to step 608.

If at step 610 the coin count is not greater than MTNUM, the program proceeds directly to step 608.

As a result of the operations described above, a single level sensor is used to enable the apparatus to keep a count of the coins in the container in order to determine whether coins are to be stored in the container or dispensed from the container. The program is designed so that any inaccuracies in the count are corrected when the level of the coins reaches that of the level sensor. If the initial count is too low because the level of coins was below the tube sensor, then the level will not be allowed to drop lower, but otherwise coins may be stored in and dispensed from the container so that the level may eventually increase to that of the level sensor. On the other hand, if initially the tube sensor was covered but the container was not full, then the level of coins may rise or fall but will not be permitted to rise any higher than the initial level.

Of course the tendency to approach the level of the sensor will depend on the cash inserted and dispensed from the apparatus, so that in actual practice the level of the sensor may not be reached. However this would only occur when there is insufficient demand for change, or an insufficient number of acceptable coins coming into the apparatus. In either case inaccuracies in the coin count are of no significance, because change is either not desired or cannot be given because of shortage of coins.

The values MTNUM and FULNUM are stored in the EAROM and can be altered at the third level of access referred to above. This enables the value FULNUM to be altered to suit individual owners' requirements, and also to be varied for different coin denominations. It is sometimes found that large coins forming a high stack may detrimentally affect the performance of the dispenser. This can be avoided by reducing the value of FULNUM.

The value of MTNUM can be changed to suit different coin containers and sizes of coins, which will alter the number of coins necessary to reach the height of the level sensor.

When the third level of access to the EAROM 60 is reached, the microprocessor is arranged to transfer the coin counts for the various containers to the EAROM 60 so that these coin counts can be inspected.

Preferably, the microprocessor is arranged to read the sensors and store an additional count (either zero or FULNUM) not only when the power is switched on, but also when the pushbutton 102 is pressed. This allows an operator to fill the coin container manually, and then start a new coin count without turning off the power.

The level sensor of each of the containers can be positioned at any desired level. For example, the level sensor could be right at the top of the container. However it is preferred that the level sensor be at a relatively low position to avoid substantially underestimating the actual level of coins at initialisation, which would cause an "exact change only" indication to be given more often than necessary. The sensor could also be right at the bottom of the container, but it is preferably higher than this so as to provide the "exact change" indication as a warning prior to the container being completely emptied. It is generally desirable that the level sensor be at or near the level of coins below which the "exact change" indication is given.

The various operations carried out by the control circuit throughout coin acceptance and dispensing stages, and the delivery of signals to the vending machine may, be way of example, correspond to the operations carried out by the circuitry of the Mentor 3000 system marketed by Mars Money Systems. By way of further example, the stored program may be arranged to cause the circuit to operate in accordance with the techniques discribed in British Patent Specification No. 2,006,501.

The coin handling apparatus of the invention may be used with machines other than vending machines, although it is particularly useful in circumstances in which change is to be dispensed. By way of example, the apparatus may be used in conjunction with pay telephones. Other examples are amusement and gaming machines, and change-giving machines.

In the illustrated embodiment, the microprocessor 50 carries out many different functions. Clearly, though, discrete circuitry could be used in place of a microprocessor, in which case many of the functions would be carried out by different, respective circuits.

What is claimed is:

1. Coin handling apparatus comprising:

at least one coin container;

means for selectively directing coins either to a first path leading to said container or to a second path;

means for selectively dispensing coins from said container;

a control means for controlling the directing means and the dispensing means, the control means being operable to keep a running estimated count of the coins in the container, to alter said count as coins are directed to and dispensed from the container, and to enable the directing means and the dispensing means based upon the running estimated count; and sensing means located adjacent to the coin container for producing an output indicative of whether or not the number of coins in the container is greater than a predetermined number, the control means being operable to modify the running estimated count in response to an alteration in the output of the sensing means.

2. Apparatus as claimed in claim 1, wherein, during a coin dispensing operation, the control means is operable to set said count equal to a first number in response to the sensing means indicating that the number of coins in the container is no longer greater than the predetermined number.

3. Apparatus as claimed in claim 2, wherein the control means is operable to set said count equal to a second number in response to the sensing means indicating that the number of coins in the container has become greater than the predetermined number and the receipt of a further coin to be directed to that container.

4. Apparatus as claimed in claim 1, wherein the control means is operable during an initialisation procedure to set the count equal to zero if the sensing means indicates that the number of coins in the container is not greater than the predetermined number, and to set the count equal to a "full" number, which is greater than said predetermined number, if the sensing means indicates that the number of coins in the container is greater than said predetermined number.

5. Apparatus as claimed in claim 4, wherein said "full" number is alterable.

6. Apparatus as claimed in claim 4, wherein the control means is operable to cause said directing means to direct further coins to said container while the count is less than a first predetermined value.

7. Apparatus as claimed in claim 6, wherein said first predetermined value is equal to said "full" number.

8. Apparatus as claimed in claim 5, wherein said first predetermined value is alterable.

9. Apparatus as claimed in claim 8, wherein said control means is operable to cause said dispensing means to dispense coins from the container while the count is greater than a second alterable value.

10. Apparatus as claimed in claim 1, wherein said control means is operable to generate a signal indicative of a low level of change when the coin count is not greater than a "low level" number.

11. Apparatus as claimed in claim 10, wherein said "low level" number is equal to said predetermined number.

12. Apparatus as claimed in claim 10, wherein said "low level" number is alterable.

13. Apparatus as claimed in claim 12, wherein said "low-level" number is stored in an addressable memory, user-operable means being provided for a user to access and alter the contents of the memory.

14. Apparatus as claimed in claim 13, wherein the memory contains further data determining how the apparatus operates, the memory having some of its contents accessible by operating the user-operable means in a first manner so as to put the apparatus in a first access mode, and other contents which are inaccessible in said first access mode and which are accessible in a second access mode requiring a different manner of operation of said user-operable means.

15. Apparatus as claimed in claim 14, wherein the apparatus is operable to receive different types of coins and to direct them along different paths, said memory storing alterable data determining the respective paths along which the different types of coins are to be directed.

16. Apparatus as claimed in any one of claims 13 to 15, wherein said memory is operable to retain its contents on interruption of a main power supply of the apparatus.

17. Apparatus as claimed in claim 16, wherein said memory is an electrically alterable read-only memory.

18. Apparatus as claimed in claim 1, wherein said sensing means is operable to indicate that the number of coins in the container is greater than said predetermined number only if a sensor for detecting a coin at a predetermined position in the container provides an output indicating the presence of a coin both before and after a predetermined delay period.

19. Apparatus as claimed in claim 1, including a plurality of containers each arranged to receive and store a respective denomination of coin, said control means storing respective counts of the coins in said containers.

20. Coin handling apparatus having control means responsive to a validator which is operable to receive and test coin-like items, the control means being operable to cause the items to be directed to different locations and to increment a credit count in response to the validator testing an item and determining that it is a genuine coin, wherein the control means has a memory storing alterable contents determining the manner in which said control means operates, the apparatus further including user-operable means permitting a user to readout at least some of the contents of said memory, said memory having first locations which are made accessible to the user by operating the user-operable means in a first predetermined manner to place the apparatus in a first access mode, and second locations which are inaccessible to the user in said first access mode and accessible in a second access mode requiring the operation of said user-operable means in a second, different predetermined manner.

21. Apparatus as claimed in claim 20, wherein said user-operable means can be operated by the user to alter the contents of the memory.

22. Apparatus as claimed in claim 21, wherein said memory includes a location the contents of which can be altered to at least one predetermined value by operating said user-operable means in one of said access modes, but which can be altered to at least one different predetermined value only by operating said user-operable means in a different access mode.

23. Apparatus as claimed in claim 20, 21 or 22, wherein the memory has a third set of locations which can be accessed by operating the user-operable means in a third predetermined manner.

24. Apparatus as claimed in claim 20, wherein said memory stores parameters determining the respective paths along which the control means directs different types of items.

25. Apparatus as claimed in claim 20, including a plurality of gates which are selectively operable by the control means to direct the items to the different locations, and wherein the memory stores parameters determining the times for which the respective gates are operated.

26. Apparatus as claimed in claim 20, wherein the memory stores parameters determining how much the credit count is incremented in response to the testing of different types of genuine coins.

27. Apparatus as claimed in claim 20, for use in a vending machine operable to dispense at least one product, wherein the memory stores information determining how much the credit count has to be incremented before said one product will be dispensed.

28. Apparatus as claimed in claim 20, wherein said control means is operable additionally to increment said credit count without determining that a tested item is a genuine coin.

29. Apparatus as claimed in claim 28, wherein said memory stores a parameter determining when said additional incrementing is to take place.

30. Apparatus as claimed in claim 20, wherein the control means is further operable to cause at least one type of genuine coin to be dispensed from a container in a change-giving operation.

31. Apparatus as claimed in claim 30, wherein one of said locations to which coins are directed is said container, and wherein the control means is operable to direct coins of that type to said container only if the number of coins in the container is less than a predetermined number stored in said memory.

32. Apparatus as claimed in claim 20, wherein the memory has an auxiliary power supply for allowing the memory to retain its contents on interruption of the main power supply.

33. Apparatus as claimed in claim 20, wherein the memory is a non-volatile electrically alterable read-only memory.

34. Apparatus as claimed in claim 1 wherein the control means includes a programmable memory for storing alterable data and wherein the locations to which coins are to be directed is determined in accordance with the alterable data stored in the programmable memory of the control means.

35. Apparatus as claimed in claim 34, having user-operable means permitting a user to access the contents of the memory so as to display said contents.

36. Apparatus as claimed in claim 35, wherein the user-operable means can be operated to alter said contents.

* * * * *

UNITED STATES PATENT AND TRADEMARK OFFICE

CERTIFICATE OF CORRECTION

PATENT NO. : 4,491,140

DATED : January 1, 1985

INVENTOR(S) : Eglise and Ruddell

It is certified that error appears in the above—identified patent and that said Letters Patent is hereby corrected as shown below:

Col. 6, line 2, "owner's" should be --owners'--.

Col. 9, line 15, "dispersing" should be --dispensing--.

Col. 9, line 56, "code indicating" should be --code (indicating--.

Col. 10, line 9, "diagostic" should be --diagnostic--.

Col. 10, line 32, "detecing" should be --detecting--.

Col. 11, line 7, "subsequent" should be --subsequently--.

Col. 14, line 27, "be" should be --by--.

Col. 14, line 32, "discribed" should be --described--.

Col. 15, line 31 (claim 8), "5" should be --6--.

Signed and Sealed this

*Third* Day of *September 1985*

[SEAL]

*Attest:*

DONALD J. QUIGG

*Attesting Officer* *Acting Commissioner of Patents and Trademarks - Designate*